US010633939B2

(12) United States Patent
Ayling

(10) Patent No.: US 10,633,939 B2
(45) Date of Patent: Apr. 28, 2020

(54) DRILLING APPARATUS

(71) Applicant: Laurence John Ayling, Sneem (IE)

(72) Inventor: Laurence John Ayling, Sneem (IE)

( * ) Notice: Subject to any disclaimer, the term of this patent is extended or adjusted under 35 U.S.C. 154(b) by 0 days.

(21) Appl. No.: 16/216,294

(22) Filed: Dec. 11, 2018

(65) Prior Publication Data

US 2019/0178042 A1 Jun. 13, 2019

Related U.S. Application Data

(63) Continuation of application No. 15/314,278, filed as application No. PCT/EP2015/061237 on May 21, 2015, now abandoned.

(30) Foreign Application Priority Data

Jun. 3, 2014 (EP) ..... 14171029

(51) Int. Cl.
*E21B 19/16* (2006.01)
*E21B 21/01* (2006.01)
(Continued)

(52) U.S. Cl.
CPC ..... *E21B 19/16* (2013.01); *E21B 21/01* (2013.01); *E21B 21/02* (2013.01); *E21B 33/068* (2013.01); *E21B 19/161* (2013.01)

(58) Field of Classification Search
CPC ..... E21B 19/16; E21B 19/161; E21B 21/01; E21B 21/02; E21B 33/068
See application file for complete search history.

(56) References Cited

U.S. PATENT DOCUMENTS 1,844,378 A * 2/1932 Campbell ..... E21B 19/10 188/67
3,518,903 A * 7/1970 Ham ..... E21B 19/16 81/57.16

(Continued)

FOREIGN PATENT DOCUMENTS

WO 01/59253 A1 8/2001
WO 2011/093716 A1 8/2011
WO 2012/176182 A2 12/2012

OTHER PUBLICATIONS

International Search Report issued in PCT/EP2015/061237; dated Nov. 10, 2015.

(Continued)

*Primary Examiner* — James G Sayre
*Assistant Examiner* — Aaron L Lembo
(74) *Attorney, Agent, or Firm* — Studebaker & Brackett PC

(57) ABSTRACT

A drilling apparatus (1) is for use on a rotary drilling rig with a top drive which enables circulation and rotation of a drill string (3) to continue uninterrupted during the making of drill string connections. It has a snubber gripping mechanism (10, 9) to enable tool joints (2, 3) to be supported and gripped with a reduced pressure chamber (5) volume and snubbing force, during tool joint connections. The gripping mechanism has gripping pads (14) arranged to move radially by relative rotation of a drive cylinder (34) causing a tapered surface (36) of the drive cylinder (34) to press against or release the pad (14). A guide cylinder (30) supports and guides the pads (14) and collets (13) for retaining a drill string at an upset shoulder (19).

18 Claims, 12 Drawing Sheets

(51) Int. Cl.
*E21B 21/02* (2006.01)
*E21B 33/068* (2006.01)

(56) References Cited

U.S. PATENT DOCUMENTS

| | | | | | |
|---|---|---|---|---|---|
| 3,722,603 | A | | 3/1973 | Brown | |
| 3,748,702 | A | * | 7/1973 | Brown | E21B 19/10 188/67 |
| 3,760,469 | A | * | 9/1973 | Brown | E21B 19/07 81/57.18 |
| 3,776,320 | A | * | 12/1973 | Brown | E21B 19/07 173/213 |
| 3,915,244 | A | * | 10/1975 | Brown | E21B 19/07 175/85 |
| 4,290,304 | A | * | 9/1981 | Eckel | E21B 19/164 73/862.25 |
| RE31,699 | E | * | 10/1984 | Eckel | E21B 19/164 73/862.25 |
| 4,867,236 | A | * | 9/1989 | Haney | A41H 37/00 166/77.51 |
| 4,869,137 | A | * | 9/1989 | Slator | B25B 5/147 81/57.18 |
| 5,746,276 | A | * | 5/1998 | Stuart | E21B 3/04 173/1 |
| 6,688,394 | B1 | | 2/2004 | Ayling | |
| 6,739,410 | B2 | * | 5/2004 | Smith | E21B 7/24 173/213 |
| 8,240,391 | B2 | * | 8/2012 | Bouligny, Jr. | E21B 19/07 166/382 |
| 2017/0191323 | A1 | * | 7/2017 | Ayling | E21B 19/16 |

OTHER PUBLICATIONS

Written Opinion issued in PCT/EP2015/061237; dated Nov. 10, 2015.

International Preliminary Report on Patentability issued in PCT/EP2015/061237; dated Dec. 6, 2016; 9pp.

* cited by examiner

DRILLING APPARATUS

PRIOR ART DISCUSSION

My prior published PCT patent specification WO2012/0176182 describes an apparatus in which joints are made or broken within a pressure chamber. Snubbers below and above the chamber take over the drive from a top drive, and apply a differential torque so that a connection may be made. The apparatus therefore achieves both continuous mud circulation and continuous rotation while making or breaking connections.

FIELD OF THE INVENTION

The invention relates to drilling apparatus, especially for drilling for hydrocarbons.

The pressure chamber is at the mud operating pressure so that circulation is continuous during disconnections and the pressure chamber can be segregated into two parts so that the upper part can be depressurised to release and accept tubulars.

It is known that snubbers can comprise chucks which move axially to grip onto the drill string, akin to the chuck of a lathe for example. However a problem with such a mechanism is that considerable volume is required in the axial direction and/or radial direction. This leads to the problems of designing a drilling apparatus that is: a) short enough in height to fit or retro-fit on many existing drilling rigs and/or b) compact enough to limit the size of the pressure chamber around the tool joint connection.

The invention addresses these problems.

SUMMARY OF THE INVENTION

According to the invention, there is provided a drilling apparatus for use on a rotary drilling rig with a top drive which enables circulation and rotation of a drill string to continue uninterrupted during the making of drill string connections, wherein the apparatus comprises a tool joint gripping mechanism arranged to rotate at the same speed as a drill string and comprising gripping pads arranged to move radially relative to a drill string tubular or upset, and a drive to drive the pads radially relative to a drill string tubular or upset.

In one embodiment, the gripping pads are wedge-shaped, with a tapered surface upon which a gripping force is exerted and a contact surface for contacting a drill string or tubular.

In one embodiment, the gripping mechanism comprises one or more drive cylinders each having an internal wedge profile which, on relative rotation, moves the pads radially to contact and grip a tool.

In one embodiment, the gripping mechanism comprises a guide to restrain the pads to move radially. In one embodiment, the drive is arranged to rotate the drive cylinder and the guide at the same speed, and to introduce a temporary relative movement to cause radial movement of the pad. Preferably, each of the drive cylinder and the guide comprises a flange which is engaged by a drive member to rotate.

In one embodiment, the drive member comprises a gear. In one embodiment, the guide and the drive cylinder overlap in the radial direction.

In one embodiment, the guide and the drive cylinder are at least partially offset in the axial direction so that they do not overlap in the radial direction for at least some of the axial dimension of the pad. In one embodiment, the guide comprises guide rings engaging upper and lower parts of the pad and the drive cylinder is arranged to engage the pad between said guide rings.

In one embodiment, the guide comprises at least one drive shaft interconnecting said guide rings.

In one embodiment, the gripping mechanism comprises collets arranged to engage an upset at a shoulder with a tubular, and a collet drive arranged to move the collet radially with respect to the tubular or upset.

In one embodiment, the collet is adjacent to the pad in the axial direction.

In one embodiment, the gripping mechanism comprises one or more drive cylinders each having an internal wedge profile which, on relative rotation, moves the pads radially to contact and grip a tool, and wherein said guide cylinder includes a port for the pad and a port for the collet.

In one embodiment, the collet drive and the pad drive are interconnected.

In one embodiment, the apparatus comprises a pressure chamber and two gripping mechanisms including an upper gripping mechanism arranged to engage a tubular or upset above the pressure chamber and a lower mechanism arranged to engage a tubular or upset below the pressure chamber.

In one embodiment, said gripping mechanisms are snubbers.

In one embodiment, the gripping mechanism comprises seals arranged to act on a tool joint upset immediately adjacent to and above and below a blind ram or valve that segregates a pressure chamber into two parts.

In one embodiment, the pads and seals are arranged to contact an upper upset and the apparatus comprises a lower gripping mechanism having grips and seals arranged to contact a lower upset while leaving space for an open blind ram or valve between them when a tool joint is connected.

In one embodiment, the collets and the pads are held in place by a keyway or ridge in the drive cylinder and are releasable by an additional rotation of the drive cylinder to facilitate inspection and replacement, being as they.

In one embodiment, the apparatus further comprises a jack arranged to lift the gripping mechanism relative to a blind ram or valve or of the blind ram or valve relative to a lower gripping mechanism to provide separation to inspect the gripping mechanisms.

In one embodiment, the lower gripping mechanism collets are configured to support a tool joint box upset shoulder (20) before the collets of the upper mechanism are closed and lowered to interfere with a tool joint pin upset shoulder.

In one embodiment, the collets provide a fail-safe support for the tool joint upset, such that the collets of the lower mechanism cannot retract until the drill string weight is taken off the collets and the collets of the upper mechanism cannot be retracted until the snubbing force is removed.

In one embodiment, the pad drive and the collet drive are related by differential gearing.

In one embodiment, the differential gearing comprises planet gears arranged such that movements of planet gears can alter the rotary relationship between the drives.

In another aspect, the invention provides a method of operation of a drilling apparatus as defined above in any embodiment, wherein the method comprises the steps of driving the gripping mechanisms so that the pads and the collets rotate at the same speed as a drill string, and retarding or advancing the pad drive to radially move the pad relative to the drill string.

In one embodiment, the apparatus is fixed to a rig floor and an extension sub in the drill string enables a bit to drill on during connections with a predetermined weight on bit.

In one embodiment, the apparatus is mounted on a hoist to allow vertical motion during connections and therefore enable continuous drilling and continuous tripping if required on new rigs.

In one embodiment, a pin upset is moved away from a box upset by the depth of the pin plus a distance to allow blind ram or valve to close and to allow mud to flow into the drill string below and out of a tubular above.

DETAILED DESCRIPTION OF THE INVENTION

Brief Description of the Drawings

The invention will be more clearly understood from the following description of some embodiments thereof, given by way of example only with reference to the accompanying drawings in which:—

DESCRIPTION OF THE EMBODIMENTS

Figure 1:
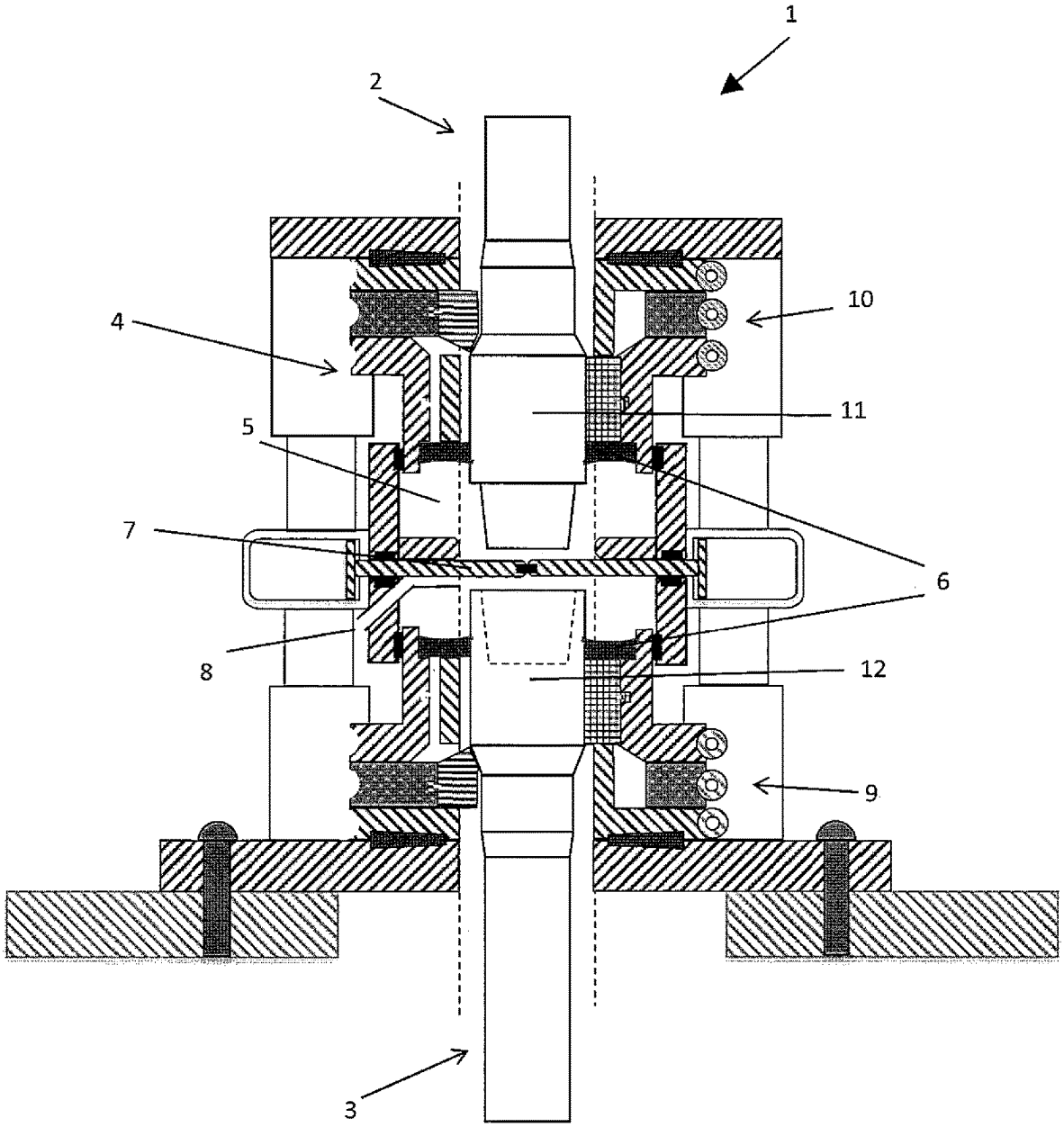
FIGS. 1, 2, and 3 are diagrammatic cross-sectional views of a drilling apparatus of the invention, the views being the same but with different parts labelled, for clarity.
Figure 2:
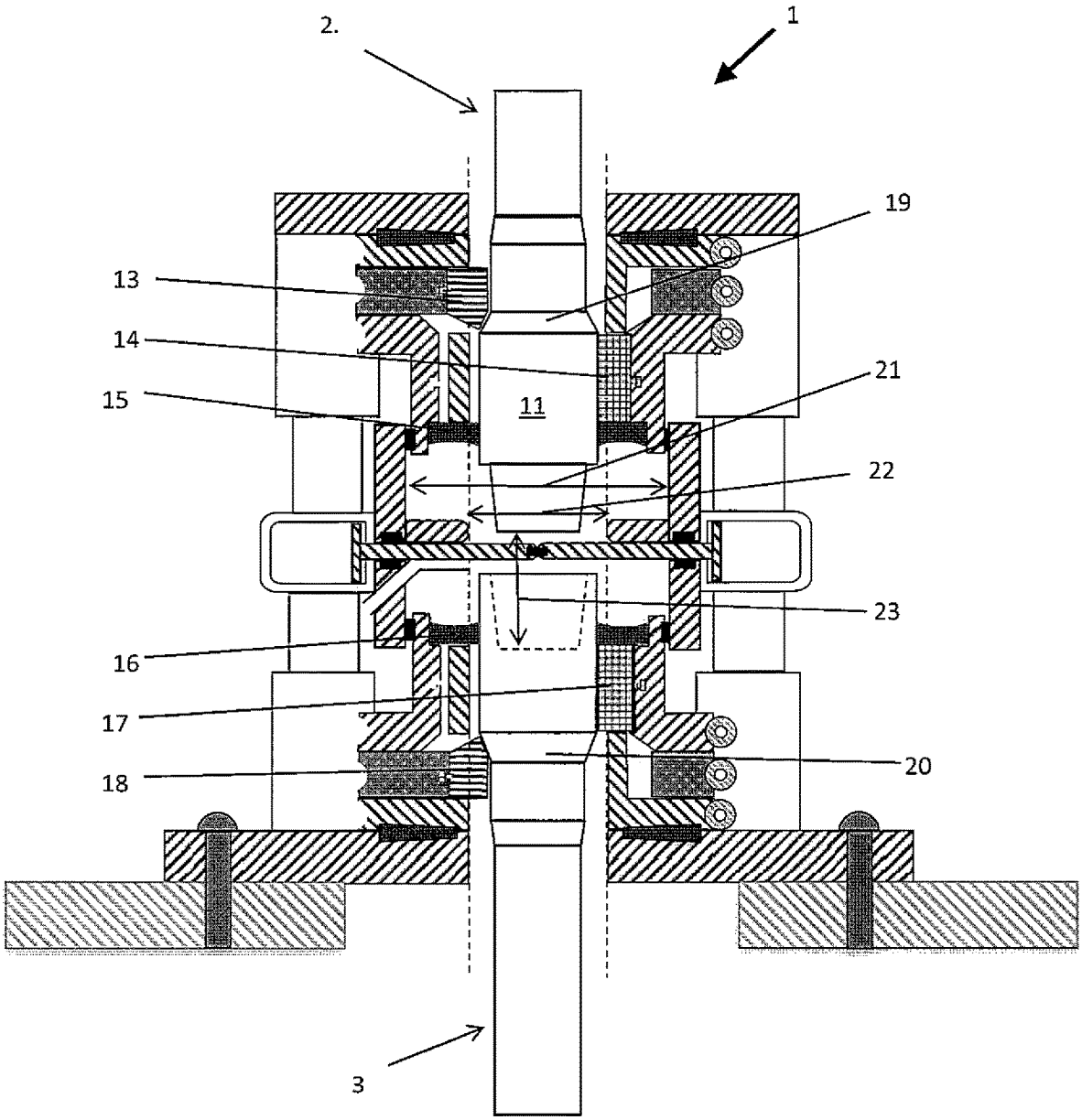

Referring to FIGS. 1 to 11 a drilling apparatus 1 comprises the following:

2, tubular, being added to or removed from a drill string 3;
4, upper snubber, driven by snubber drives 10;
5, pressure chamber with seals 6;
7, blind ram for dividing the chamber 5;
8, mud inlets and outlets for continuous circulation in a lower chamber half during tubular addition or removal;
9, lower snubber and drill string drive;
11, 12 tool joint upset pin, tool joint upset box,
13, 14, 15 upper collets, grips and seals of the upper snubber,
16, 17, 18 lower seals, grips and collets of the lower snubber,
19, 20 tool joint upset (pin) shoulder, tool joint upset (box) shoulder chamber seals, upper and lower,
21, pressure chamber internal diameter,
22, blind ram or valve bore,
23, travel of pin out of box,
24, jack to raise snubber above the blind ram 7,
25, jack to raise blind ram above drill string drive 9,
26, jack to raise the apparatus,
27, rig floor on which the apparatus is mounted,
28, apparatus base, if not mounted on the rig floor,
30, 31 upper snubber guide cylinder-and drive,
32, 33 upper snubber collet drive cylinder and drive, and 41, internal tapered surface of the collets drive cylinder;
34, 35 upper snubber grips drive cylinder and drive, and 36 internal tapered surface of the grips drive cylinder;
37, width of both cylinders (guide and drive),
38, grips retaining key, sliding in the grips drive cylinder keyway
39, wedge angle of ~9½°,
40, centres of curvature,
42, collet retaining key, sliding in the collet drive cylinder keyway
43, gear wheel for engaging a drive such as a spur gear 31,
44, ports for the collets,
45, ports for the grips,
46, collets gear teeth, driven by collets drive spur gear 33,
48, grips drive cylinder gear wheel, driven by spur gear 35,
49, piston rings to seal with pressure chamber
61, guide cylinder width, ~32 mm,
62, drive cylinder max width, ~64 mm,
63, pressure chamber bore, ~432 mm,
64, travel of pin out of box, ~203 mm,
65, travel of upper snubber away from valve, 100 mm,
66, travel of valve away from drill string drive, 100 mm,
67, valve bore, 229 mm,
68, dimension, overall width, ~1067 mm, The overall height is about 1092 mm, In the apparatus 1 gripping by a snubber is achieved by a circumferential taper which, as it rotates, presses the grips 14 radially to grip the tool joint upset 11. This saves considerable space in the axial direction enabling the sliding seals in the pressure chamber wall to be reduced from a diameter of approximately 584 mm down to approximately 432 mm in the case of concentric cylinders (apparatus 1, a described below), or 381 mm in the case of the apparatus 70. This, in turn, reduces the snubbing force, from a possible 900 tonnes (at a chamber pressure of 345 bar), down to a more manageable 500 tonnes or 400 tonnes respectively. This is also necessary because high snubbing forces directly relate to increased size and weight of the jacks and longer actuation times.

The radial wedges or 'grips' 14 have teeth on the inside curved surface to grip the tool joint upset 11 and transmit torque; and a smooth outside curved surface to slide within the smooth internal curved profile 36 of the drive cylinder 34. Thus, when the drive cylinder 34 rotates faster than the grips 14, the grips 14 are forced inwards and into contact with the tool joint upset 11. When the drive cylinder 34 rotates slower than the grips, the grips 14 are retracted outwards and away from contact with the tool joint upset 11. When the drive cylinder 34 is rotating at the same speed as the grips 14, the grips 14 do not move radially inwards or outwards. The gradient of the radial wedges is similar to the gradient used typically in axial slips of approximately 1 in 6, or 9.5°.

The invention avoids problems associated with the known methods for gripping drilling tubulars (including wrenches, rotating rollers, Kelly bushing, or vice jaws). The prior approaches require mechanical, electric or hydraulic actuation, which requires significant space. Additionally, transmission of such mechanical, electric or hydraulic power to the rotating collets, wedges or seals is complex.

The curved wedge-shaped grips 14 occupy approximately half of the radial space of conventional gripping mechanisms, without requiring additional vertical space. This enables the diameter of the upper and lower snubbers to be reduced by about 152 mm and approximately halves the snubbing force to about 400 to 500 tonnes, as above. This allows space to 'park' the blind ram 7 or valve between the upper and lower snubbers when the tool joint is connected, enabling the bore of the blind ram or valve to be minimised to the bore of the apparatus.

In more detail, the drilling apparatus 1 assumes concentric cylinders; an outer drive cylinder 34 with internal wedging profile 41 and an inner concentric guide cylinder 30 to guide the collets 13, wedges 14 or seals 15.

Figure 3:
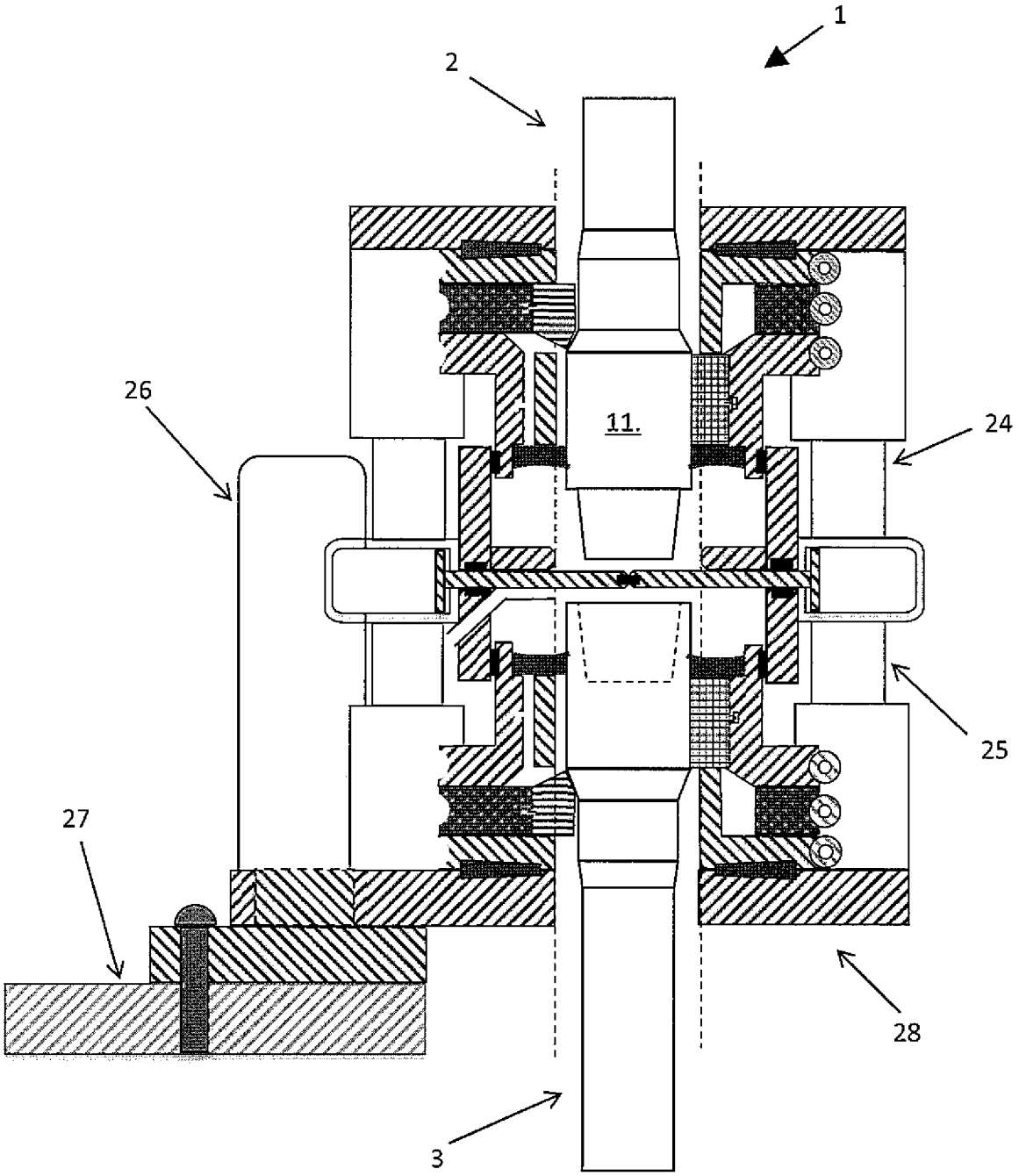

FIG. 3 illustrates and labels the jacks 24, 25, and 26 required to separate the snubber from the drill string drive, by some 203 mm, being shared equally by the upper and lower jacks (24 and 25). The apparatus 1 may be used on the rig floor 27 in conjunction with an extension sub ("Xsub") to allow the drill string 3 to extend. The jack 26 enables the apparatus to be raised to access any tool joint. However, when used on a new rig and mounted on a vertical hoist, the apparatus 1 will be light enough to facilitate continuous drilling and tripping, working in harmony with a top drive (not shown) and automated tubular 2 handling system.

Figure 4:
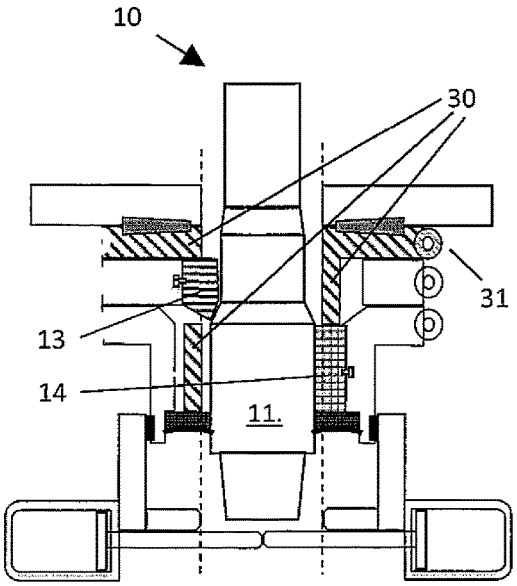
FIGS. 4, 5 and 6 are similar diagrams all illustrating a guide cylinder, a collet drive cylinder and a grips drive cylinder, but with different parts labelled, for clarity.
Figure 5:
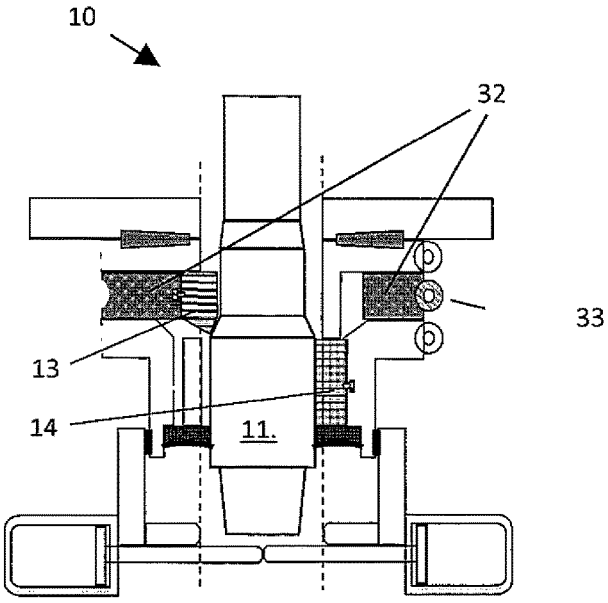
Figure 6:
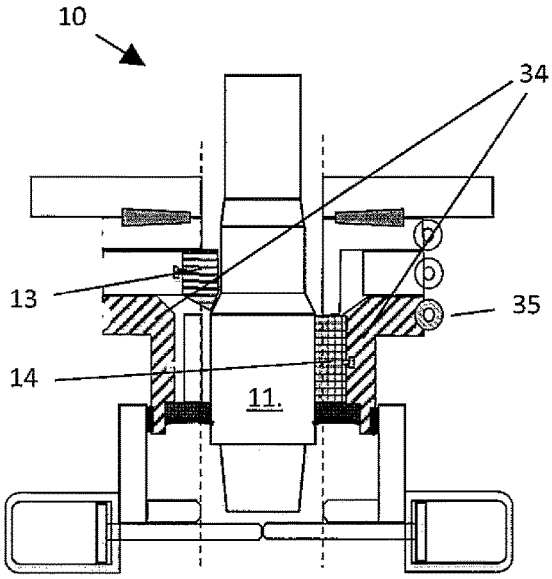

FIGS. 4, 5 and 6 show the upper snubber in more detail. Rotation of the seals, grips and collets is achieved by the guide cylinder 30 of internal bore 229 mm and thickness of ~38 mm, sufficient to transmit the necessary torque to the upper snubber to make or break a tool joint connection. The guide cylinder 30 is mounted on a bearing of sufficient strength to apply the high snubbing force when the tubular 2 has to be inserted into the pressure chamber 5, and it is rotated by a guide cylinder drive 31.

The grips drive cylinder 34 is rotated by the drive gear 35 and, when rotated faster or slower than the guide cylinder 30 it causes the grips 14 to move in or out of contact with the tool joint upset.

The collet cylinder 32 is rotated by the collet cylinder drive gear 33, and it can have the same internal profile as the grips drive cylinder 34. It is required to act separately from the drive cylinder, since the collets 13 are actuated before the tool joint lands and after it departs. The purpose of the collets 13 is to retain the drill string 3 in place by acting on the taper 19 at the upper end of the riser 11. In general it is not applying pressure, only when there is an upward force applied to the tubulars 2 on the top side of the pressure chamber. Of course, the lower collets 18 act likewise for downward force of the tubulars 2 below the pressure chamber 5.

Figure 7:
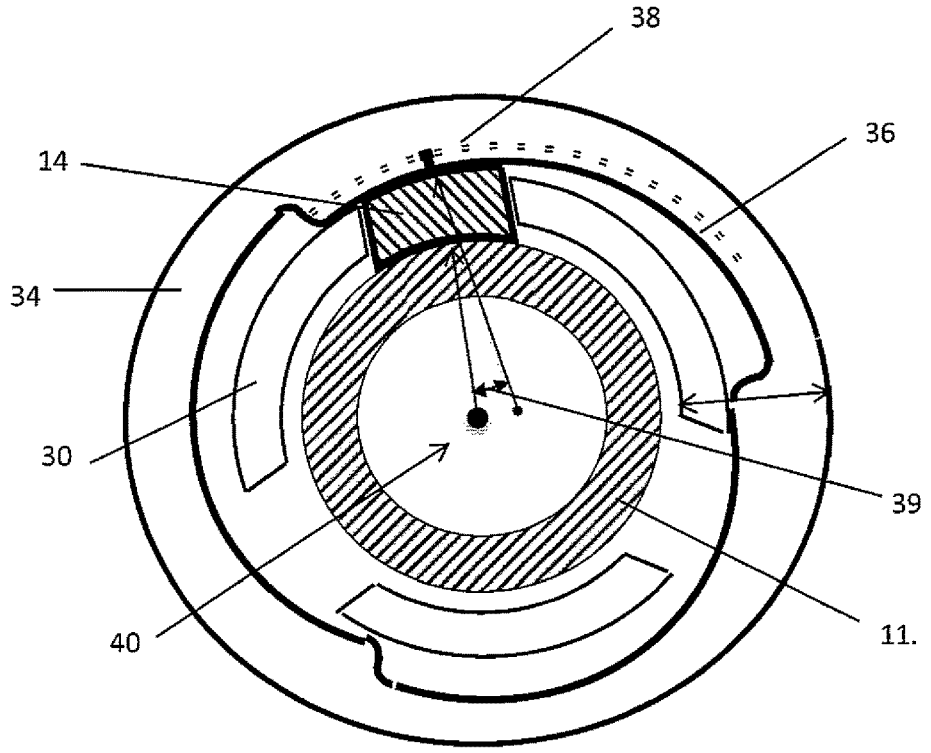
FIGS. 7 and 8 are cross-sectional plan views showing radial movement of the ("thick") grips and collet, respectively in the apparatus of FIGS. 1 to 6.

FIG. 7 shows the grips drive cylinder 34 internal profile 36, with a slope or wedge angle of some 9½°. The grips 14 are thick enough to slide through the guide cylinder 30 ports 45 (FIG. 9) and are slidably attached to the grips drive cylinder 34 by retaining keys 38 sliding in a keyway in the curved face 36 of the grips drive cylinder 34. When there is no tubular within the apparatus 1, the grips 14 may be rotated enough to slide the keys 38 out of the keyway and release the grips 14 for inspection or replacement.

Figure 8:
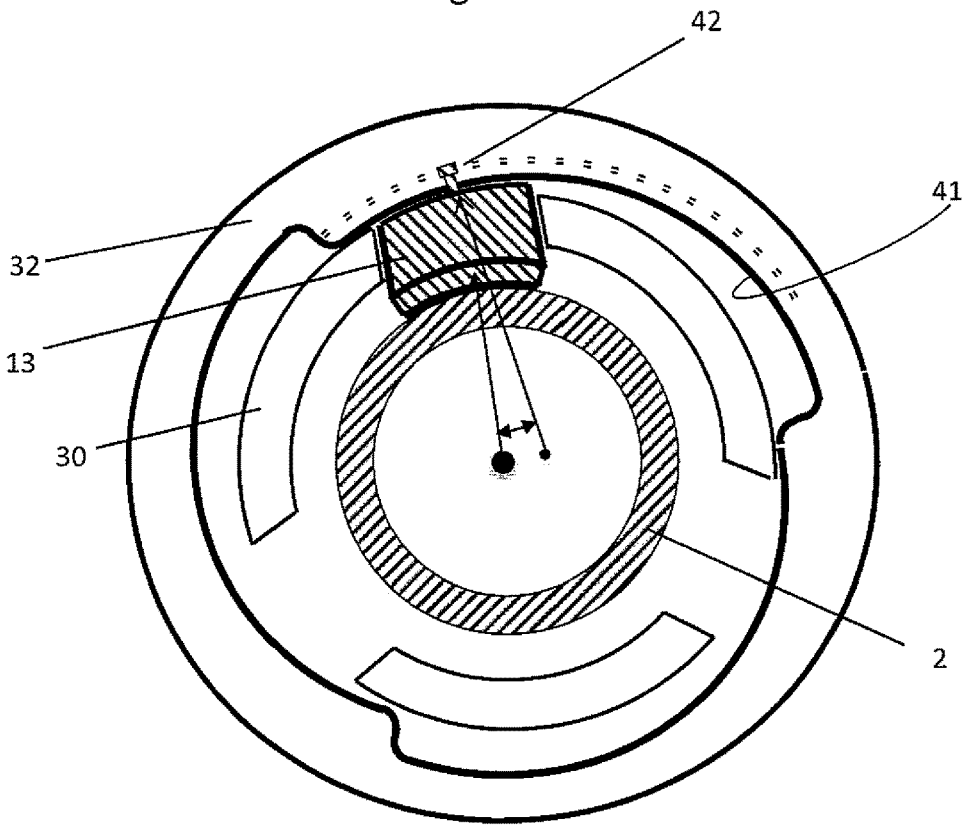
Figure 9:
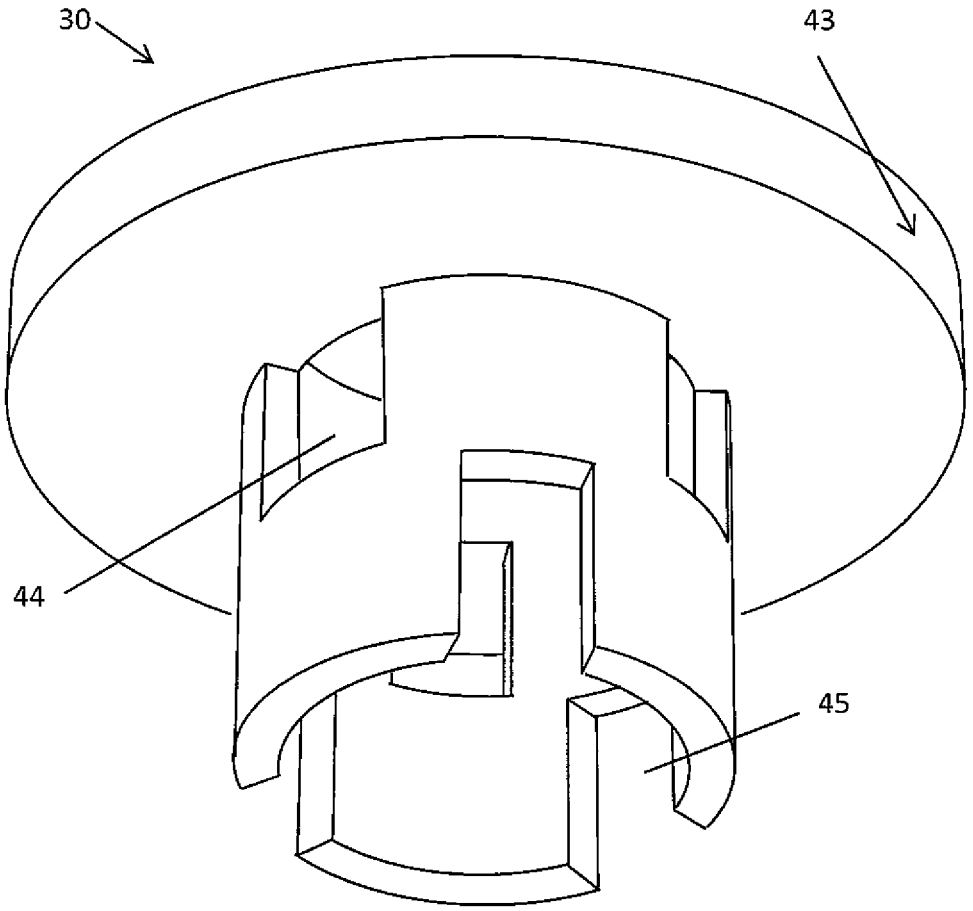
FIGS. 9, 10 and 11 are perspective views of a guide cylinder, a collet drive cylinder, and a grips drive cylinder of this apparatus, respectively.
Figure 10:
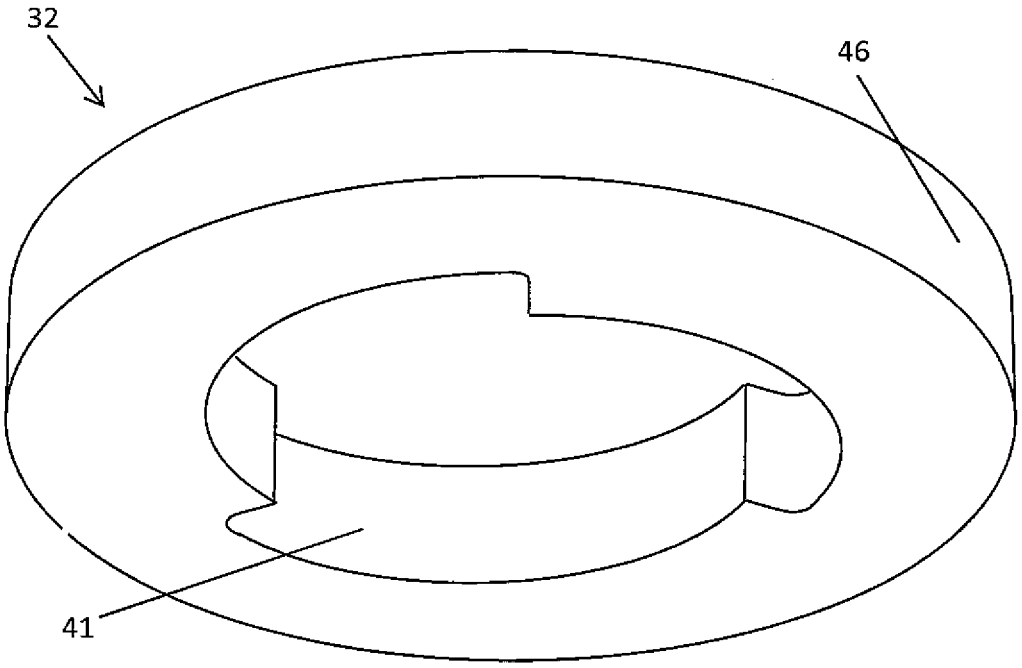
Figure 11:
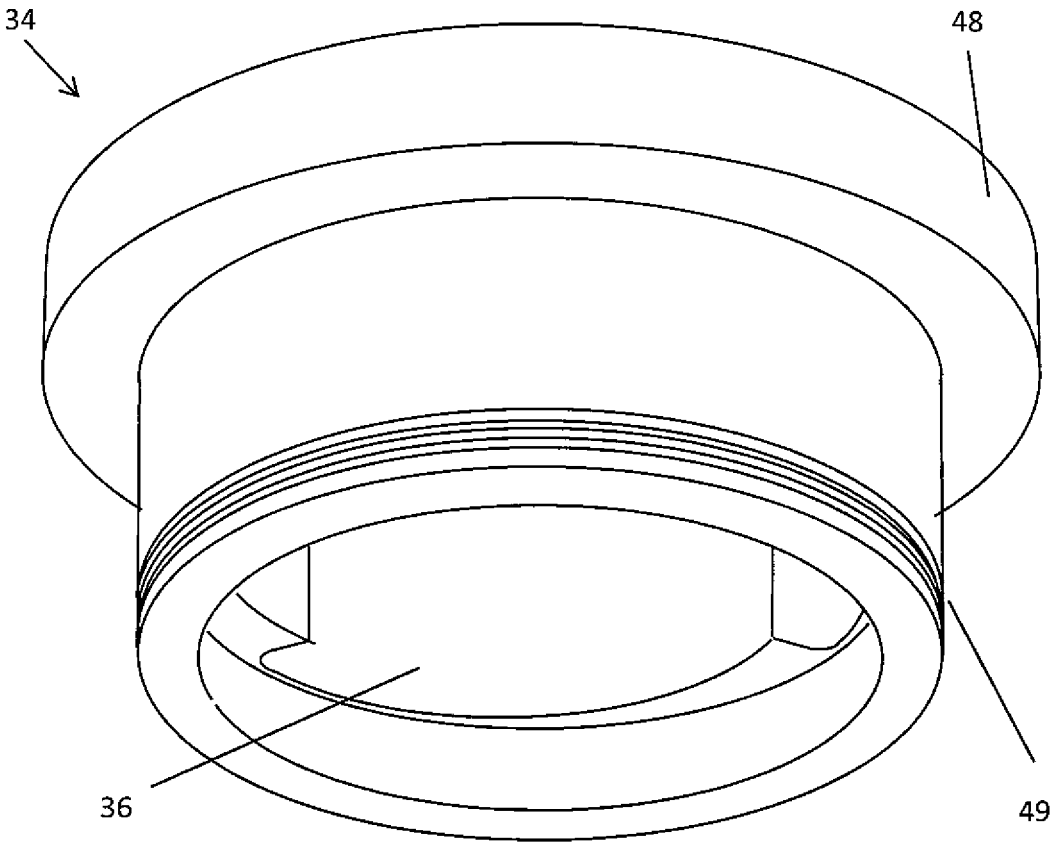

FIG. 8 shows the collets drive cylinder 32 of similar profile 41 to that of the grips drive cylinder 34 and the same radial drive principles apply. The collets drive cylinder 32 will be rotated a predetermined amount to ensure that the collets interfere with the upset shoulder 19 without gripping the tubular shaft. As shown in FIG. 9 the guide cylinder 30 has ports 44 for the collets 13 in addition to ports 45 for the grips 14.

Regarding the sequence of operation, the collets 13 of the drill string drive are moved into place and locked in place in the ports 44, before the tool joint upset 11 is landed on the collets 13 to interfere with the upset shoulder of the tool joint. The drive cylinder 32 for the collets is independent of the grips drive cylinder 34, thereby making the motion of the collets 13 independent of the motion of the wedges or grips 14. Because the shoulder of the box upset 11 is only 20°±2° to the vertical, the mounting of collets 13 in the drill string drive is allowed to move laterally, just sufficiently to allow the drill string to be subsequently centralized by the grips 14, thus allowing the gripping force between the grips to balance out.

In the case of the collets 13 of the snubber, these are moved into place after the drill string 3 has landed on the collets of the drill string drive 9 before disconnections, or after a new tubular 2 is inserted into the snubber 10. In either case, the snubber 10 may move downwards to allow the collets 13 to engage the shoulder of the pin tool joint upset, before all of the grips 14 and seals are actuated to engage the tool joint upset 11.

Since the seals, grips and collets need to be replaced when worn, and because of the limited travel required, they are devised as replaceable inserts, which are sized to suit each particular drill pipe size 168 mm, 152 mm, 149 mm, 140 mm, 127 mm, 114 mm, 102 mm, (and even 89 mm, 73 mm, & 67 mm). This allows the apparatus 1 actuation to be a modest fixed travel for all the seals and grips of ~19 mm (plus up to 6 mm for any tool joint upset wear); and 25 mm for the collets; regardless of the drill pipe size from 67 mm to 168 mm (being tool joint upset diameters of 89 mm to 102 mm).

It will be appreciated that in various embodiments there is a drive cylinder with a wedging internal profile which rotates relative to the grips, such that the grips are forced inwards or retracted outwards. This relative rotation may be provided as shown by drive gears 35 or by a concentric guide cylinder or concentric guide discs guiding the grips, or by chain. This provides a compact and simple mechanical actuation, which: minimises the volume and weight of the pressure chamber 5; minimises the diameter of the pressure vessel and therefore minimises the force necessary to snub the tubular and drill string into the pressure vessel.

It will also be appreciated that the collets, grips and seals can be easily removed for inspection and replacement by sliding out of the keyways shown 38 and 42 and may also be sized to perfectly suit each size of tool joint upset dimensions. The travel of these collets, grips and seals from their retracted positions to contact with the tool joint upsets is therefore minimised to less than 25 mm, including the additional travel when the tool joint upset is worn. These replaceable collets, grips and seals can therefore accommodate most tool joint sizes.

The apparatus minimises the travel of the seals, grips and collets, so that inserts can be used appropriate to each standard tool joint size plus moderate wear; minimises the bore 22 of the blind ram or valve 7; and minimises the travel 23 of the pin 11 from the box 12; and minimises the height, weight, complexity and cost of the drilling apparatus 1.

The sealing between the pressure chamber 5 wall, which contains the blind ram or valve 7, and the upper snubber 10 above and the lower snubber or drill string drive 9 below, can be effected using piston ring technology 49, as developed for marine diesel engines, not hitherto applied to drilling equipment.

When the guide and drive components in the upper snubber 10 rotate at the same speed, the collets, grips and seals in the upper snubber do not move radially. Likewise, when the guide and drive components in the drill string drive 9 rotate at the same speed the collets, grips and seals in the drill string drive do not move radially. However in both cases when there is a difference in rotation between the guide and drive components, the collets, grips or seals are actuated to move radially.

This travel of the pin out of and away from the box of approximately 203 mm is shared between the vertical movement of the pressure chamber wall relative to the drill string drive of approximately 102 mm and the movement of the snubber relative to the pressure chamber of approximately 102 mm.

Because the gripping mechanism of the invention is applied to the tool joint upset 11 instead of to the tubular shafts or bodies 2, the gripping force to achieve sufficient torque to rotate the drill string plus break a connection may be increased to 108 k Nm or even 136 k Nm, compared to conventional torque of some 88 k. This will be limited by the hoop strength of the drive cylinder and torsional strength of guide cylinder or discs, and the power limit of the gear train, for which special high strength materials may usefully be chosen.

The grips 17 of the drill string drive 9 are positioned to grip the box tool joint below the threaded part (of some 127 mm) to minimise distortion of the threads, which could otherwise overly affect the necessary breaking and intended making up torques.

The simple mechanical drive cylinder and guides concept significantly minimises the number of components and/or moving parts, which should also increase reliability and minimise cost.

To achieve continuous drilling, the drill bit will be able to drill ahead during connections at a known constant "WOB" (weight on bit) by either lowering the drilling apparatus during connections or, particularly when applied to existing drilling rigs, where the available height is limited, inserting an extending sub or tubular, (Xsub), in the drill string close to the neutral point, being approximately above, or close to the top of, the drill collars or the HWDP (Heavy Weight Drill Pipe) section, which is addressed in a separate patent.

Choosing high strength materials to apply sufficient gripping, with the grips (curved wedge) radial dimension from 19 mm to 44 mm and the drive cylinder varying in thickness from 19 mm to 57 mm, the internal diameter of the pressure chamber may be reduced to approximately 356 mm, which would reduce the snubbing forces to 344 tonnes (at 345 bar drilling fluid operating pressure) or 516 tonnes (at 517 bar).

The seals, grips and collets are preferably equally spaced around the tool joint, there being two or more of each (preferably three of each as shown in illustrations). Though some compliance in the mounting of the collets and their drive cylinders, will enable the grips to subsequently centralize the tubular and drill string prior to connection or disconnection and balance the gripping forces.

In one mode of use, first the lower collets 18 are closed so that the next box tool joint upset shoulder (17*b*) can 'land' on them, thus zeroing the distances of the grips, seals, valve and collets above to match the tool joint dimensions. Once landed the upper collets 13 close and move down to find the pin tool joint upset shoulder 19. Then all grips and seals move inwards to contact the joint upset 11. Then the pressure chamber 5 fills with drilling fluid up to the circulating pressure and the tool joint can be broken, separated and the valve closed, so that the upper chamber can be de-pressured, opened and a new tubular inserted.

Figure 12:
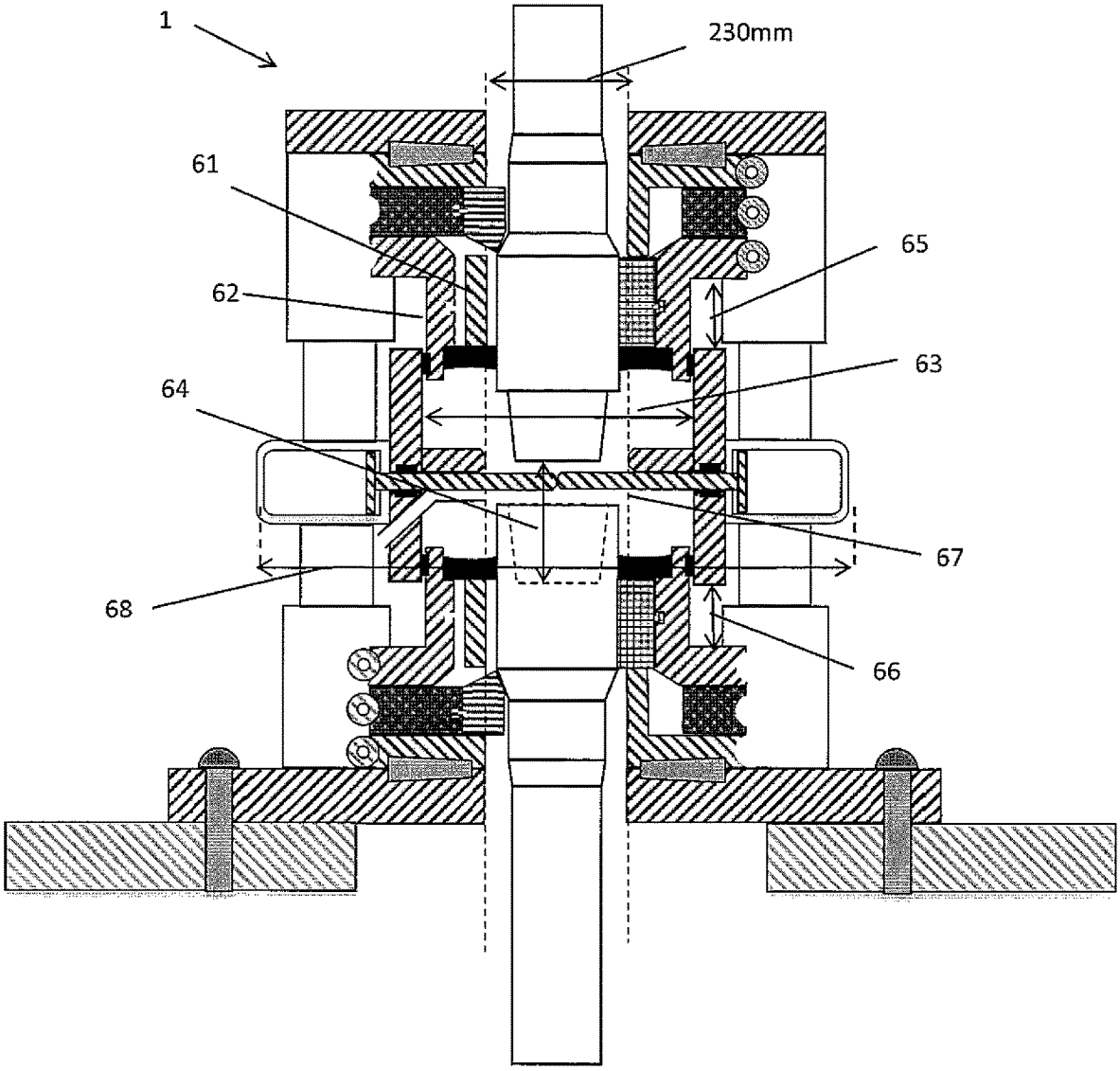
FIG. 12 is a diagrammatic cross sectional view showing dimensions of the drilling apparatus of the above drawings.
Figure 13:
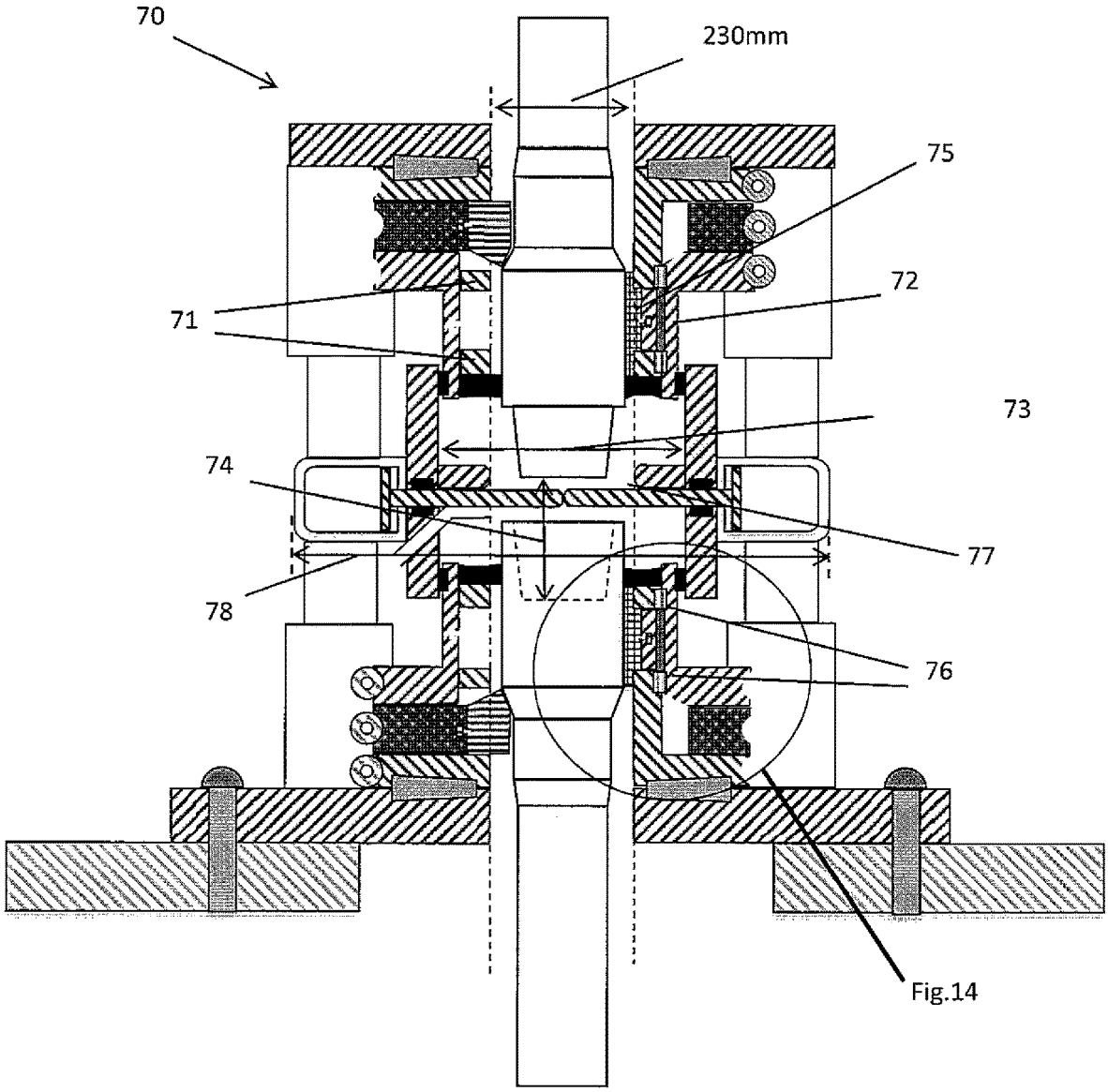
FIG. 13 is a diagrammatic cross sectional view of an alternative drilling apparatus according to this invention, incorporating guide rings and "thin" grips; leading to smaller lateral dimensions.
Figure 14:
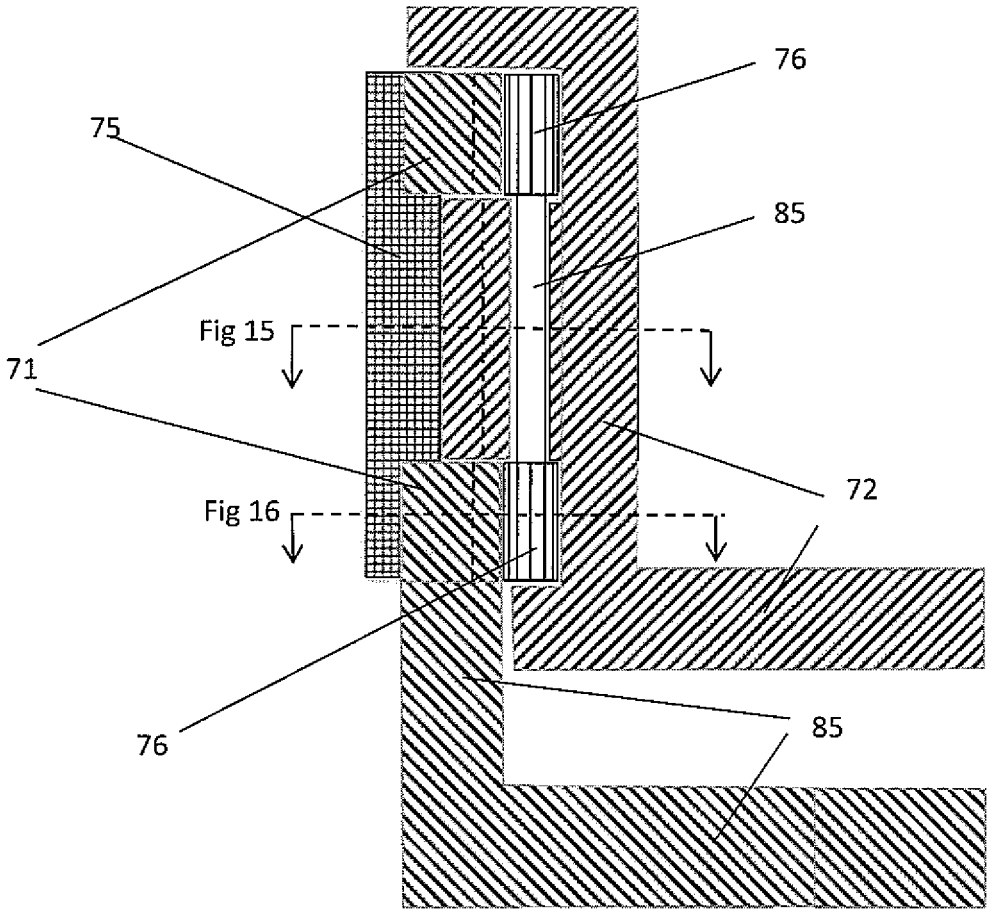
FIG. 14 is an enlarged cross-sectional view showing the arrangement of "thin" grips, guide rings, and grips drive cylinder in the drilling apparatus of FIG. 13.

FIG. 12, together with the other drawings, shows advantageous aspects as follows:

- The radial wedge mechanism with two concentric cylinders enables the pressure chamber diameter to be reduced to 432 mm, which halves the snubbing forces that would be required with conventional actuation.
- With 127 mm to 152 mm long grips and 51 mm long seals on the pin upset lengths of 203 mm and with the box upset length of 254 mm enough space is left to park the open valve of width ~76 mm between the snubber and drill string drive. So, the valve bore can reduce to the 229 mm bore of the apparatus.
- With a thinner valve blade, the separation of pin and box is minimised, for example, to 203 mm, with the valve moving vertically by some 102 mm relative to both the snubber and the drill string drive, which enables the snubber and drill string drive to have identical components.
- Two differential gear boxes drive the guide, grips drive and collets drive cylinders, in either the snubber or the drill string drive, and enable the rotation of the cylinders to be accurately related, and the torques to be accurately applied.
- One main differential gear box drives the snubber and drill string drive, enabling the rotation of the snubber and drill string drive to be accurately related and torques, to make or break the connection, to be accurately applied.
- Using keyways in the grips and collets drive cylinders enables the grips and collets to be retracted from contact with the tool joint and by rotating further the keys can slide out of the keyways to release the grips or collets for inspection or replacement.

Alternative Drilling Apparatus, 70

An alternative drilling apparatus, 70, with a gripping mechanism of the upper snubber and the lower snubber is shown in more detail in FIGS. 13 to 16 and 18. The guide cylinder of the previous embodiment is replaced by two guide rings 71, above and below a grips drive cylinder 72. This enables the grips 75 to be of a reduced thickness to reach the tool joint upset without the thickness of the guide cylinder in between. This minimises the diameter of the drive cylinder 72, which minimises the internal diameter of the pressure chamber and hence the snubbing forces required to contain the operating pressure of the pressure chamber, which may be 345 bar or even 500 bar or higher.

70, Drilling apparatus,
71, guide rings, width ~38 mm,
72, grips drive cylinder, max width ~70 mm,
73, pressure chamber bore ~380 mm,
74, travel of pin out of box ~203 mm,
75, thin grips max width ~38 mm,
76, gears and shaft connecting the guide discs,
77, valve bore 375 mm,
78, overall width ~864 mm,
80, actuation of grips drive cylinder between 2 guide discs,
83, minimum thickness ~38 mm,
84, maximum thickness ~76 mm,
85, gear shafts connecting guide discs,
87, total thickness ~76 mm, The overall height is about 1100 mm, The guide cylinders of the apparatus 1 may be replaced by guide rings, above and below the grips drive cylinder wedge profile. The pressure chamber bore may be reduced to about 230 mm plus the drive cylinder width, which needs to be the depth of the wedge profile ~38 mm, plus sufficient width to contain the hoop stress ~32 mm, plus a sealing distance of some 6 mm; reducing the pressure chamber bore to 381 mm, which may, if extra strength materials are used, be reduced to 356 mm.

The collet 51 width of 51 mm to 76 mm is adequate to transfer the high snubbing force on to the apparatus body and, in the case of the drill string drive, the collets support the entire drill string weight. The guide rings 71 are adequately strong to force the grips into wedging contact between the tool joint upset and drive cylinder profile, or to break such wedging contact. The drive cylinder 72 is strong enough to withstand the high hoop stress of the wedging action. The guide rings 71 are connected structurally or, as shown, by gears 76 on a shaft 85 to ensure that the forces on the top and bottom of the grips 75 are balanced.

Figure 15:
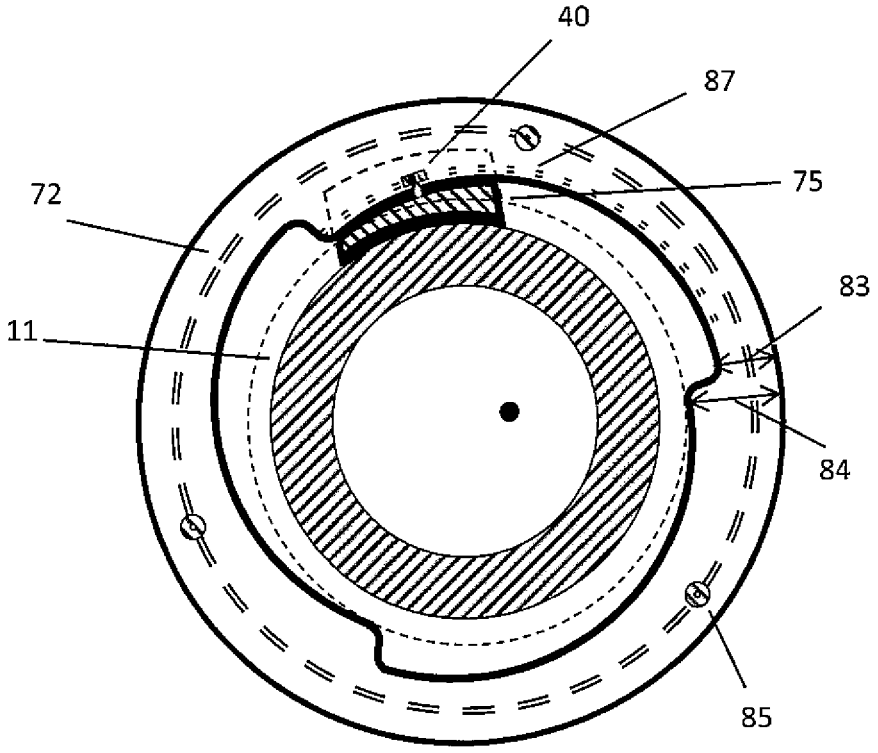
FIGS. 15 and 16 are plan cross sections along the lines shown in FIG. 14, through the grip and through the guide ring respectively.
Figure 16:
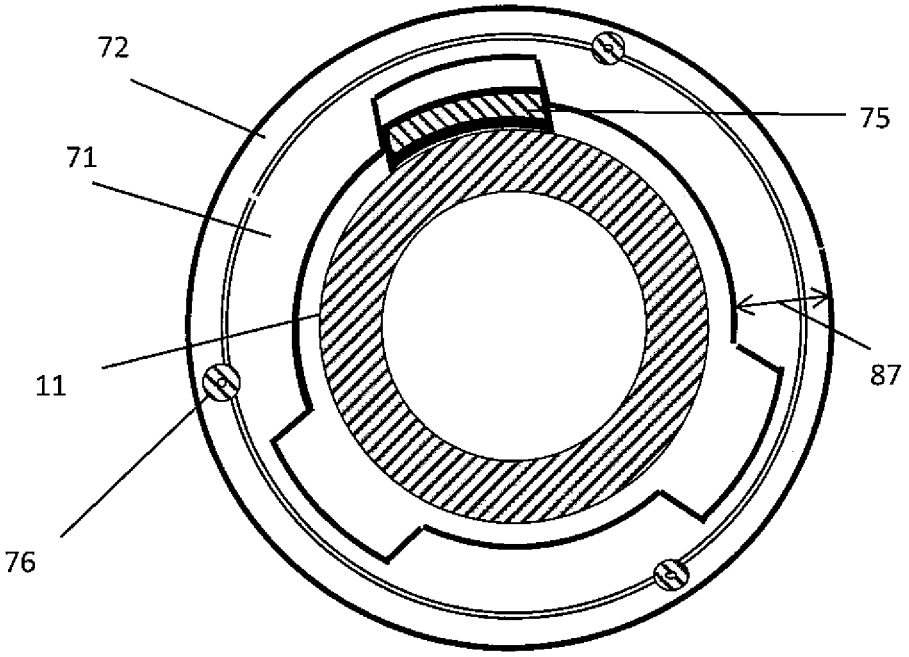

FIGS. 15 and 16 illustrate the relationship between the drive cylinder 72, the thin grips 75, and the tool joint upset 11 or 12 in the arrangement of the apparatus 70. The guide rings 71 being above and below the wedging profile of the drive cylinder, but connected by the gear shafts 85.

Referring back to FIG. 2, the seals 15 and 16 need only a radial motion of only about 25 mm to make contact with the tool joint and then the pressure of the drilling fluid within the pressure chamber adds to the sealing force. The seals are moved into place and retracted by the motion of the grips. In the case of the grips 14 and 17, the radial motion of about 25 mm is achieved by rotating the drive cylinder relative to the guide cylinder, so that the grips are moved radially. The grips move a short distance of only about 19 mm to contact the tool joint and then the drive cylinder profile tightens up the gripping force. This travel may be increased to 25 mm if the tool joint upset is significantly worn down.

Figure 17:
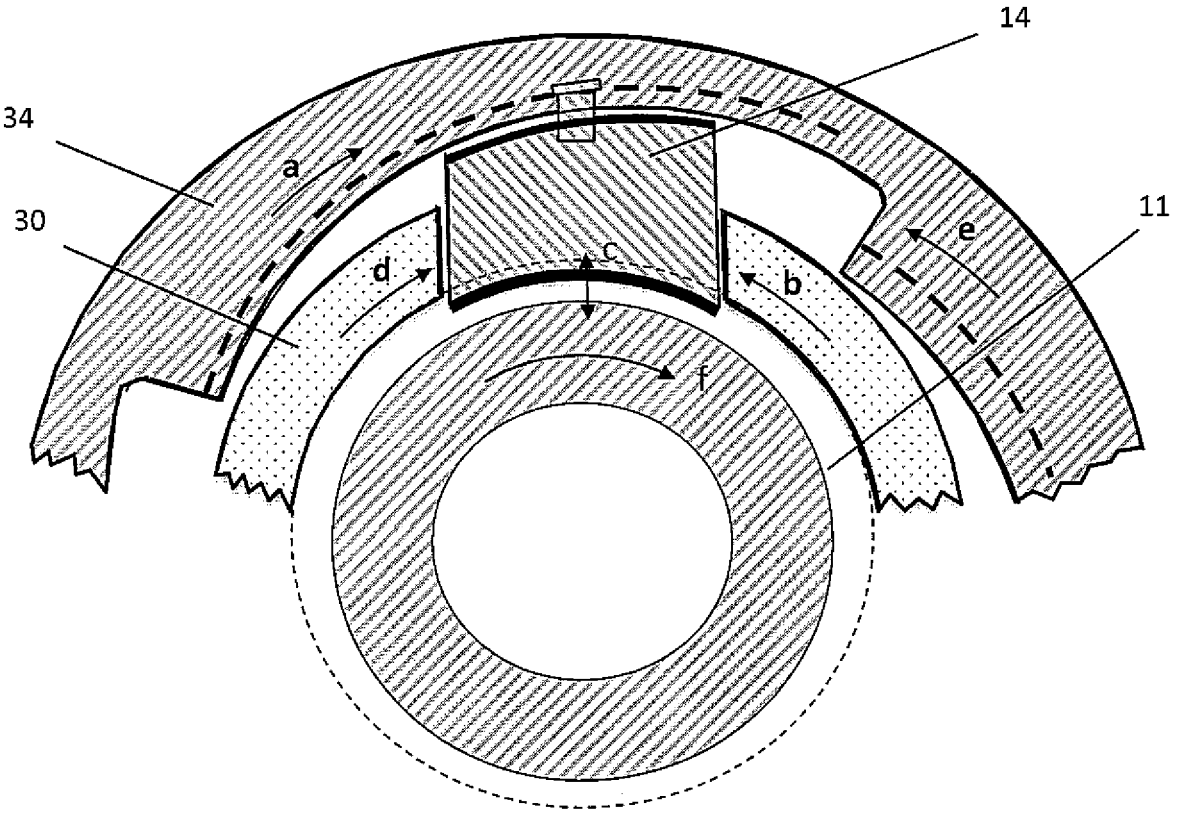
FIGS. 17 and 18 show plan cross sections through the gripping mechanisms of FIGS. 1 and 13, to illustrate the driving forces achieved.

FIG. 17 is a representation of part of the gripping mechanism of the apparatus 1 for comparison purposes, with "thick" grips 14, drive cylinder 34, guide cylinder 30, and tool joint upset surface 11. The force "a" arises with the grips drive cylinder 34 rotating faster, and the force "e" when it is slower. The guide cylinder 30 exerts corresponding guiding forces "d" and "b" respectively to retain the grip 14 in the radial direction, and "c" denotes the radial force of the grip 14.

Figure 18:
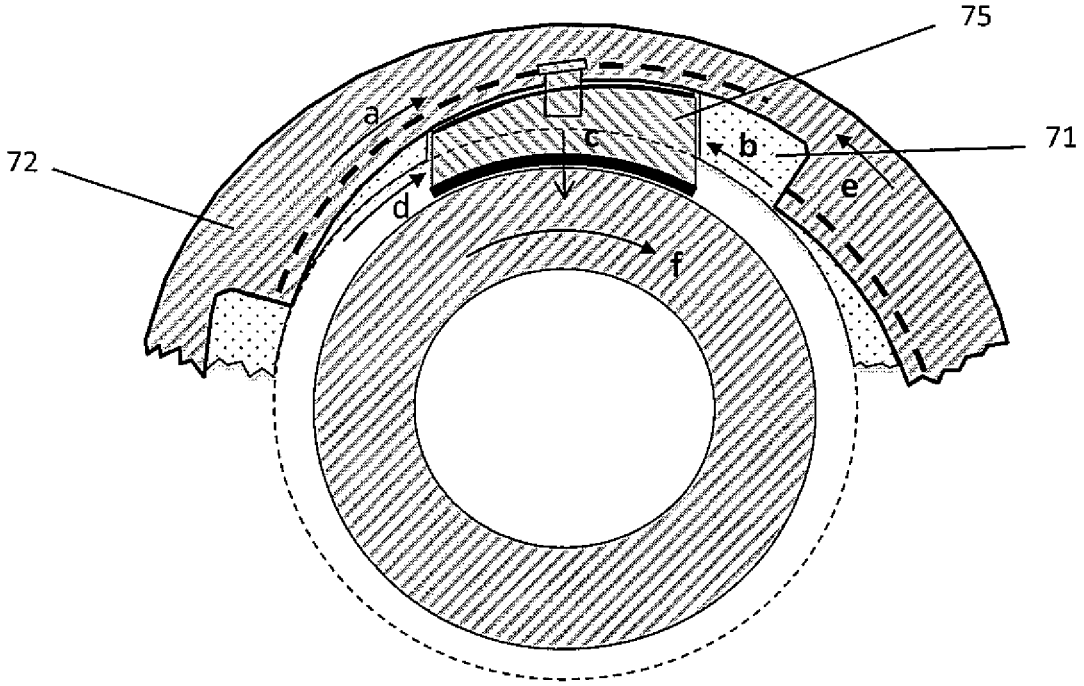

FIG. 18 is a representation of part of the gripping mechanism of the apparatus 70 for comparison purposes, with the thin grips or wedges 75, drive cylinder 72, and guide rings 71. The forces are indicated by the same letters as used in FIG. 17.

The further reduction in size provided by the apparatus 70 is illustrated in FIG. 18, wherein the guide cylinder 32 of the apparatus 1 (shown in FIG. 17) is replaced by the two guide rings 71 which guide only the top and bottom of the 'thinner' grips 75 with the grips drive cylinder 72 driving the middle of the grips 75. With high strength materials this may further reduce the internal diameter of the pressure chamber to some 356 mm diameter and the snubbing force to some 344 tonnes (if the operating pressure is raised to 345 bar) or some 525 tonnes (if the operating pressure is raised to 500 bar).

It should be emphasised that the geometry is such that the locii of the centres of curvature of the drive cylinder profile and the grips profile are not the same but close enough to be accommodated in the design of the guides of the guide cylinder. Using 120° (⅓ of the rotary plane) per grip (if three grips are used) and using the 1 in 6 gradient, the radial travel of each grip of ~25 mm is more than adequate to allows for the reduced diameter of a worn tool joint.

It also allows for rotating the cylinders relative to each other by an extra 10° or so to allow the collets, grips and seals to be released from the keyways in the drive cylinders, for inspection or replacement.

It will be appreciated that the invention provides a drilling apparatus for allowing continuous circulation and rotation while adding or removing tubulars from a drill string during the drilling of a well. The collets act on the shoulders of the tool joint upset and positively snub the tubular and drill string into a pressure chamber, grips to grip the tool joint upsets and transmit torque to make or break tool joint connections, seals to seal the tool joint upsets into the pressure chamber, blind ram or valve to separate the upper and lower parts of the pressure chamber.

The collets, or grips or seals are actuated by a mechanical system which is simple and compact, to minimise the pressure chamber size and weight, the snubbing forces, the number of components, moving parts, and cost. The drive cylinder with a wedging internal profile, when rotated relative to the rotating collets, forces them inwards to support, contact or grip the tool joint upset. Such relative rotation is effected by the drive cylinder rotating relative to a concentric guide cylinder, which is restraining the collets, grips or seals.

There may alternatively be guide discs or rings replacing the guide cylinder to guide the collets, grips or seal and achieve the relative motion with the drive cylinder that achieves or relieves the wedging actuation and thus further reducing the internal diameter of the pressure chamber and the drilling apparatus The collets, may be held in place with keys sliding in keyways in the sloping or wedging face of the drive cylinder. The collets may be released if, by rotation, the keys are released from the said keyways and thereby enabling collets, grips or seals to be easily removed for inspection or replacement. The collets may be sized to suit the range of tool joint upset dimensions of the typical range of drilling tubular sizes. The required tool joint separation of the pin from the box may be shared between an axial motion of the snubber, which is an upper snubber, relative to the pressure chamber and an axial motion of the pressure chamber relative to the drill string drive, which is a lower snubber.

The seals may be connected to the grips and moved into or out of place by the movement of the grips and in which the seals can be further actuated by the drilling fluid pressure. The sealing between the upper and lower snubbers and the pressure chamber may be effected by piston ring technology. Also, there may be an extended jacking motion of either of the two snubbers relative to the pressure chamber, sufficiently to separate them by some 152 mm to enable the collets, grips or seals to be easily replaced.

It will be appreciated that the invention achieves the benefits of:

a) Replacing the conventional actuating mechanisms with a simple compact mechanism, and/or
b) providing improved gripping of drill string tubulars by gripping the tool joint upsets, instead of the tubular shafts, and/or
c) sealing against the tool joint upsets immediately above and below the tool joint connection;
d) reducing the bore of the blind ram or valve to the bore of the apparatus, and/or
e) achieving short travels, small mud volumes, fast connections.

It will also be appreciated that drilling apparatus of various embodiments of the invention that have a gripping mechanism with a radially-moving wedge-shaped gripper (a "radial wedge") enables some or all of the following:

A short machine in height (1 m to 2 m), to fit on many existing drilling rigs. This is especially so because it can in many instances grip the tool joint, rather than the tubular shaft.

The breaking or make-up connection torques to be increased substantially by gripping the robust tool joint, clear of the threaded sections.

Landing the tool joint and supporting the drill string within the machine to 'zero' the location and eliminate the need for 'tagging' time (minutes) before connections.

A small machine in width (1 m to 2 m), to minimise the weight (3 to 5 tonnes) to facilitate 'skidding' (installation and removal) on the rig floor.

Fast connection times due to the small travel (~25 mm) of: the rotating collets (supporting the drill string and/or snubbing the connection), the rotating grips (gripping the tool joint) and the rotating seals (sealing against the tool joint).

Fast connection times due to the small pressure chamber volume (<625 $mm^3$) to be filled or drained of drilling fluid during connections by having both seals inside the grips rather than outside and directly adjacent to the blind ram or valve.

Fast connection times due to very fast mechanical actuation times (5 to 10 seconds each) of the collets, grips and seals.

Snubbing forces reduced to a manageable level of 400 tonnes at 345 bar (or 600 tonnes at 517 bar) instead of some 700 tons at 345 bar, for any conventional actuation.

Jacking reduced to a 102 mm separation of snubber relative to the valve, a 102 mm separation of Valve relative Drill String Drive; plus a 152 mm additional extension of either jack, at no internal pressure, to easily inspect or replace collets, grips & seals, and piston rings.

Collets, grips and seals specifically sized for each standard tool joint size to fit curvatures exactly and act on the tool joint upset within a short distance (<25 mm).

Collets, grips and seals easily installed and held in place for actuating or retracting, by sliding into, and along, keyways or guides in the drive cylinders.

Few moving parts or components more than, preferably, 2 valve blades, 4 drive cylinders with internal wedge profiles plus 2 guide cylinders, restraining the 6 collets, 6 grips & 6 seals, to radial motion, thus reducing complexity to some 26 components and increasing reliability.

The valve, segregating the pressure chamber into two parts and capable of withstanding up to 345 bar, reduced from some 559 mm bore to 229 mm bore, by 'parking' the open valve, between the upper snubber and lower snubber, when the tool joint is connected. Application on the rig floor with an extension sub ("Xsub") to extend the drill string (for existing rigs); or application on a hoist to facilitate vertical motion while connecting (for new build rigs, facilitating continuous tripping).

The actuation geometry relies on the locii of the centres of curvature (c of c) of the sliding surfaces between the grips and the wedge profile being close enough to accommodate in the mechanical design. (The locus of the c of c for the grips sliding surface, moving in the guide cylinder or guide discs, being 'linear'; and the locus of the c of c of the sliding surface of the internal wedge profile of the drive cylinder being 'an arc'; with a disparity, between the orientation of the grips and drive sliding surfaces, being less than 1°).

The invention is not limited to the embodiments described but may be varied in construction and detail.

The invention claimed is:

1. A drilling apparatus for use on a rotary drilling rig with a top drive which enables circulation and rotation of a drill string having a longitudinal axial direction to continue uninterrupted during the making of drill string connections, the drilling apparatus comprising a tool joint gripping mechanism arranged to rotate at the same speed as the drill string and including:

gripping pads arranged to move radially relative to the drill string, said gripping pads being wedge-shaped, with a tapered surface upon which a gripping force is exerted and a contact surface for contacting the drill string and a pad drive to drive the pads radially relative to the drill string, collets arranged to engage and retain the drill string upset at a shoulder, a collet drive arranged to move the collets radially with respect to the drill string, and a guide cylinder having ports for the pads and for the collets, and being adapted to rotate the pads and the collets and to restrain the pads and the collets to move radially, wherein the pad drive comprises a pad drive cylinder with an internal wedge profiles which, on rotation relative to the pads when it rotates faster or slower than the guide cylinder, moves the pads radially to engage or disengage the drill string.

2. The drilling apparatus as claimed in claim 1, wherein the collet drive comprises a collet drive cylinder with internal wedge profiles which, on rotation relative to the collets when it rotates faster or slower than the guide cylinder, moves the collets radially to engage or disengage the drill string.

3. The drilling apparatus as claimed in claim 1, wherein at least one of the drive cylinder and the guide comprises a flange which is engaged by a drive member to rotate.

4. The drilling apparatus as claimed in claim 1, wherein at least one of the drive cylinder and the guide comprises a flange which is engaged by a drive member to rotate, and wherein the drive member comprises a gear.

5. The drilling apparatus as claimed in claim 1, wherein the guide cylinder and the pad drive cylinder overlap in the radial direction.

6. The drilling apparatus as claimed in claim 1, wherein the guide includes guide rings and at least one drive shaft interconnecting said guide rings.

7. The drilling apparatus as claimed in claim 1, wherein at least one of said collets is adjacent to at least one of said pads in the axial direction.

8. The drilling apparatus as claimed in claim 1, wherein the collet drive and the pad drive are interconnected.

9. The drilling apparatus as claimed in claim 1, wherein:

the apparatus comprises a pressure chamber and an upper gripping mechanism arranged to engage the drill string above the pressure chamber and a lower gripping mechanism arranged to engage the drill string below the pressure chamber; and wherein said gripping mechanisms are snubbers, or the apparatus comprises a pressure chamber and an upper collet mechanism arranged to engage the drill string above the pressure chamber and a lower collet mechanism arranged to engage the drill string below the pressure chamber; and wherein said collet mechanisms are snubbers.

10. The drilling apparatus as claimed in claim 1, wherein the gripping mechanism comprises seals arranged to act on the drill string tool joint upset immediately adjacent to and above and below a blind ram or valve that segregates a pressure chamber into two parts; and wherein the pads and the seals are arranged to contact an upper upset and the apparatus comprises a lower gripping mechanism having grips and seals arranged to contact a lower drill string upset while leaving space for a blind ram or valve when a tool joint is connected.

11. The drilling apparatus as claimed in claim 1, wherein the collets and the pads are held in place by a keyway or ridge in the guide cylinders and are releasable by an additional rotation of the drive cylinder to facilitate inspection and replacement.

12. The drilling apparatus as claimed in claim 1, wherein the apparatus comprises a pressure chamber, an upper gripping mechanism arranged to engage a tubular or upset above the pressure chamber, and a lower gripping mechanism arranged to engage a tubular or upset below the pressure chamber; and wherein the apparatus further comprises a jack arranged to lift the upper gripping mechanism relative to the lower gripping mechanism to provide separation to inspect the gripping mechanisms; and wherein the lower gripping mechanism comprises collets which are configured to support a tool joint box upset shoulder before collets of the upper mechanism are closed and lowered to interfere with a tool joint pin upset shoulder; and wherein the collets provide a fail-safe support for the tool joint upset, such that the collets of the lower mechanism cannot retract until the drill string weight is taken off said collets and the collets of the upper mechanism cannot be retracted until the snubbing force is removed.

13. The drilling apparatus as claimed in claim 1, wherein the pad drive and the collet drive are related by differential gearing; and wherein the differential gearing comprises planet gears arranged such that movements of planet gears alters the rotary relationship between the drives.

14. A method of operation of a drilling apparatus on a rotary drilling rig with a top drive which enables circulation and rotation of a drill string to continue uninterrupted during the making of drill string connections, wherein the apparatus comprises a tool joint gripping mechanism arranged to rotate at the same speed as the drill string with an upset, and comprising:

gripping pads arranged to move radially relative to the drill string said gripping pads being wedge-shaped, with a tapered surface upon which a gripping force is exerted and a contact surface for contacting the drill string, a pad drive to drive the pads radially relative to the drill string, collets arranged to move radially with respect to the drill string, a guide cylinder having ports for the pads and for the collets, and being adapted to rotate the pads and the collets and to restrain the pads and the collets to move radially, and wherein the pad drive comprises a pad drive cylinder with internal wedge profiles which, on rotation relative to the pads when it rotates faster or slower than the guide cylinder, moves the pads radially to engage or disengage the drill string, wherein the method comprising steps of:

retarding or advancing the collets to move radially inwardly or outwardly, and retarding or advancing the pad drive, causing the pads to move radially inwardly or outwardly.

15. The method as claimed in claim 14, wherein the apparatus is fixed to a rig floor and an extension sub in the drill string enables a bit to drill on during connections with a predetermined weight on the bit.

16. The method as claimed in claim 14, wherein a drill string pin upset is moved away from a drill string box upset by the depth of the pin plus a distance to allow a blind ram or a valve to close and to allow mud to flow into the drill string below and out of a tubular above.

17. The method as claimed in claim 14, wherein the apparatus is mounted on a hoist to allow vertical motion during connections and therefore enable continuous drilling.

18. The method as claimed in claim 14, wherein the apparatus comprises a pressure chamber and an upper gripping mechanism arranged to engage the drill string above a pressure chamber and a lower gripping mechanism arranged to engage the drill string below the pressure chamber.

* * * * *